US006765181B1

(12) United States Patent
Chatterjee et al.

(10) Patent No.: US 6,765,181 B1
(45) Date of Patent: Jul. 20, 2004

(54) INDUCTOR ASSEMBLY

(75) Inventors: Madhu S. Chatterjee, Troy, MI (US); Byron L. Taylor, Commerce Township, MI (US); Micah Robert Black, Troy, MI (US)

(73) Assignee: Inductoheat, Inc., Madison Heights, MI (US)

( * ) Notice: Subject to any disclaimer, the term of this patent is extended or adjusted under 35 U.S.C. 154(b) by 0 days.

(21) Appl. No.: 10/663,423

(22) Filed: Sep. 16, 2003

Related U.S. Application Data

(60) Provisional application No. 60/411,194, filed on Sep. 17, 2002.

(51) Int. Cl.[7] ..... H05B 6/40

(52) U.S. Cl. ..... 219/632; 219/635; 219/670; 219/675; 219/676; 266/129; 148/567; 148/574; 336/199

(58) Field of Search ..... 219/632, 635, 219/639–641, 670, 672, 676, 677; 148/567, 574; 266/129; 336/199, 208

(56) References Cited

U.S. PATENT DOCUMENTS 2,620,425 A * 12/1952 Seiler ..... 219/604
3,031,554 A * 4/1962 Jackson ..... 219/611
4,759,808 A * 7/1988 Novorsky ..... 148/572

* cited by examiner

*Primary Examiner*—Philip H. Leung
(74) *Attorney, Agent, or Firm*—Philip O. Post

(57) ABSTRACT

An apparatus and process are provided for induction heat treatment of electrically conductive workpieces. The inductor assembly is formed from a single piece inductor that utilizes an electrically non-conductive top, side and bottom frames to hold flux concentrators in place over the sides of the inductor. Flux concentrators can be changed by unfastening the frame members, removing the existing flux concentrators, inserting new flux concentrators, and fastening the frame members. One or more of the frame members may serve as a receiving chamber for supply of a quench medium to an induction heated workpiece positioned in an opening in the inductor.

9 Claims, 5 Drawing Sheets

INDUCTOR ASSEMBLY

CROSS REFERENCE TO RELATED APPLICATIONS

This application claims the benefit of U.S. Provisional Application No. 60/411,194, filed Sep. 17, 2002.

FIELD OF THE INVENTION

The present invention relates to an inductor assembly, and in particular, to an inductor assembly that is formed from a small number of components and is easily adapted to various applications for induction heat treatment of metals or other electrically conductive materials.

BACKGROUND OF THE INVENTION

Metal components of an article can be heat treated and metallurgically hardened by magnetic induction. One such article is a camshaft that has multiple lobes and bearing areas disposed along the length of a cylindrical shaft. The lobes are of an eccentric shape and are oriented in varying angular directions relative to the axial length of the shaft. The bearings are cylindrically shaped. The lobes can be heat treated and metallurgically hardened by magnetic induction. The eccentric shape of the lobes complicates the design of an inductor for use in the heat treatment process. One method is to use a top and bottom clam shell type of hinged inductor that has an opening conforming to the shape of the lobe to be heat treated. The lobe is positioned in the bottom half of the clam shell inductor and the top half of the clam shell inductor is closed around it. The clam shell inductor is connected to a suitable ac power source so that ac current flowing through the inductor will create a magnetic field that penetrates the lobe and induce eddy current in the lobe. The eddy current heats the lobe and a quench is used to metallurgically harden the lobe. Further induction hardening of the lobe may require a uniform heating pattern or a contoured heating pattern that must be accomplished in differently shaped inductors. These types of coils arc used to heat the lobes only.

An object of the present invention is an inductor assembly for induction heat treatment of electrically conductive workpieces, such as the lobes of a camshaft, that is simple in design, including an inductor formed from a single piece of bar stock; no brazing of parts; no water cooling of the inductor; and minimal machining requirements. A further object of the invention is to produce an inexpensive inductor assembly that can be used in universal induction heat treatment applications.

BRIEF SUMMARY OF THE INVENTION

In one aspect, the present invention is an apparatus for, and method of, inductively heat treating workpieces with an inductor assembly. In one example of the invention, the inductor assembly comprises an inductor; a pair of flux concentrators; top, bottom and side frames; and fasteners to hold the frames in place around the inductor and flux concentrators. The inductor is formed from a single piece of stock material. AC current from a suitable power supply to the inductor creates a magnetic field that inductively heats a workpiece placed in an opening in the inductor. Quench passages can be provided in one or more of the frames and the inductor to provide a path for a quench medium to the workpiece in the opening. Induction heating patterns produced by the inductor assembly can be modified by changing the flux concentrators used in the inductor assembly. These and other aspects of the invention are set forth in this specification.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 6(*b*) is a top side view of the top or bottom frame shown in FIG. 6(*a*).

FIG. 7(*b*) is a top side view of one example of a side frame used in the inductor assembly shown in FIG. 1.

DETAILED DESCRIPTION OF THE INVENTION

Figure 3:
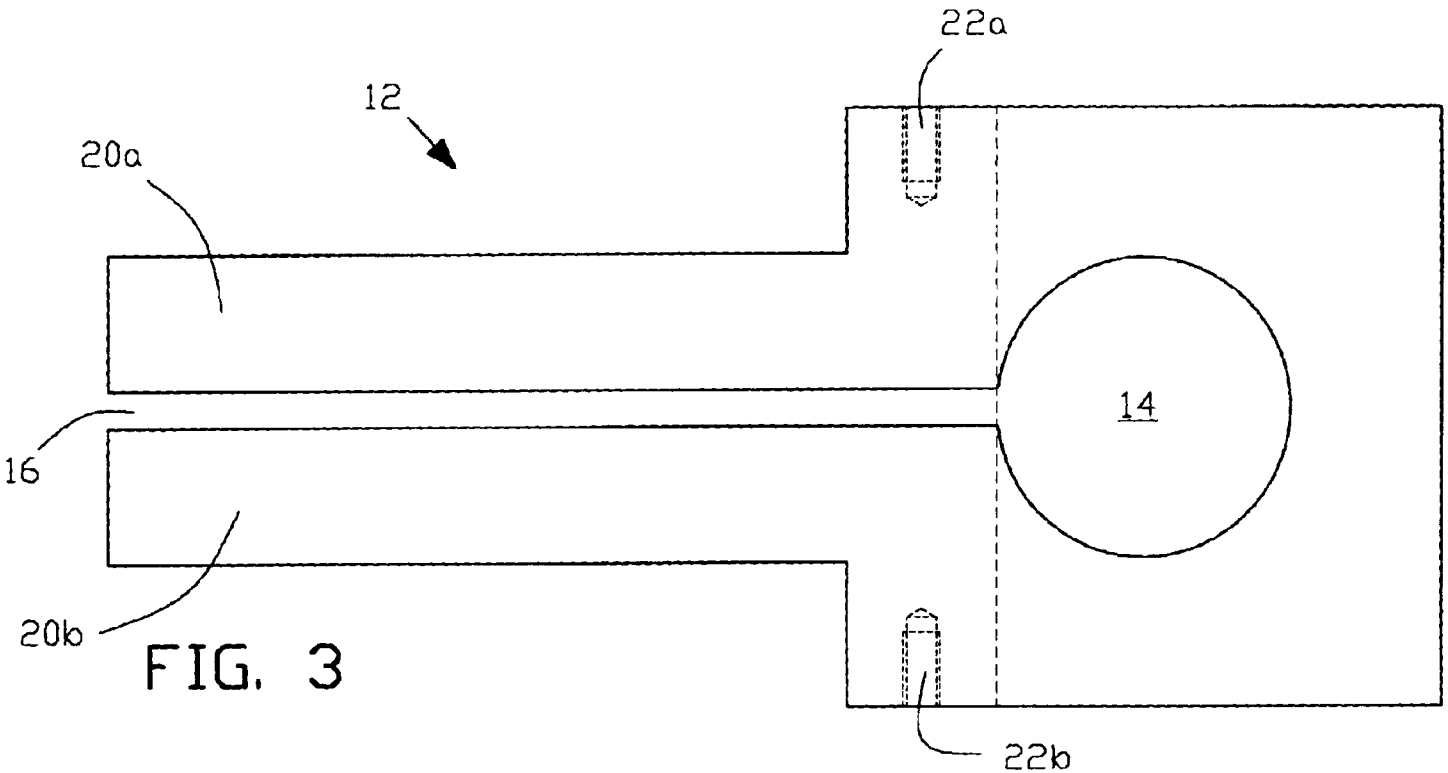
FIG. 3 is a front side view of one example of an inductor used in the inductor assembly shown in FIG. 1.
Figure 4:
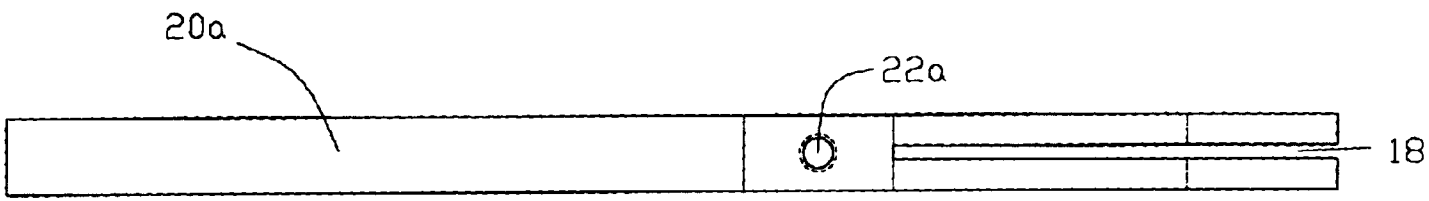
FIG. 4 is a top view of the inductor shown in FIG. 3.

Referring now to the drawings, wherein like numerals indicate like elements, there is shown in the drawings, one example of an inductor assembly 10 of the present invention. The inductor assembly comprises inductor 12, a pair of flux concentrators 30, top and bottom frames 40, side frame 50, and suitable fasteners to hold the components together. Inductor 12, as best illustrated in FIG. 3 and FIG. 4, can be fabricated from commercially available copper bar stock, such as, but not limited to, a 4-inch wide by 0.5-inch thick copper bar cut to a 9-inch length. Other electrically conductive stock may be used in other embodiments of the invention. Inductor opening 14, leg slot 16 and inductor slot 18 can be machined into the copper bar. While inductor opening 14, which passes through the width of the inductor, is illustrated as being circular in shape, in other examples of the invention, the inductor opening may be shaped to conform to the shape of a workpiece to be induction heat treated in the opening. The length of the bar is narrowed at one end by machining the bar to form legs 20*a* and 20*b*. Leg slot 16 extends from the rectangular ends of legs 20*a* and 20*b* to inductor opening 14. The legs provide means for connecting the inductor to a suitable single phase ac power source. Means for attaching fasteners to the inductor, such as threaded holes 22*a* and 22*b*, can be milled into the inductor. In this manner, an inductor comprising a continuous single-turn coil can be fabricated.

Figure 5:
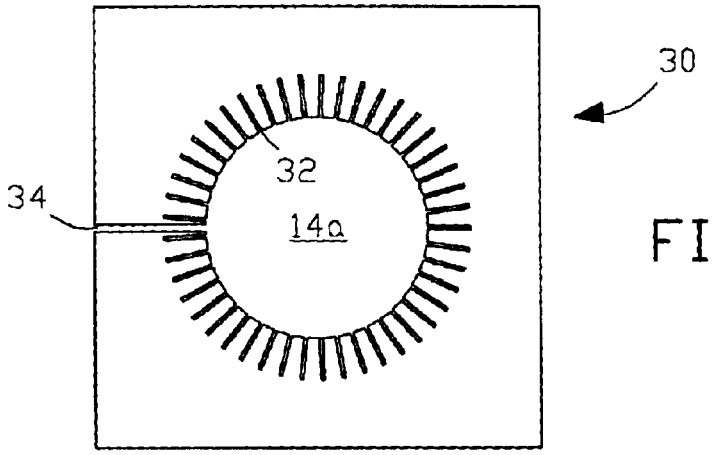
FIG. 5 is a front side view of one example of a magnetic flux concentrator used in the inductor assembly shown in FIG. 1.

FIG. 5 illustrates one example of magnetic flux concentrator 30 used with the inductor assembly of the present invention. The flux concentrator comprises a mild steel sheet having a plurality of radially distributed slots 32 about a center opening 14*a* that is approximately the same size as inductor opening 14 in this non-limiting example of the invention. The slotted openings may be otherwise configured in other examples of the invention so as to achieve a desired magnetic field distribution around a workpiece placed inside inductor opening 14 (workpiece opening). Further a flux concentrator may only partially surround inductor opening 14 in other examples of the invention. Slot 34 provides an electrical discontinuity in the flux concentrator and is generally of the same width of leg slot 16. Flux concentrator 30 can be stamped from a sheet of mild steel, such as a 3/64-inch thick sheet, and may be coated with a heat resistant material, such as a high temperature polymer-derived ceramic composition, to extend the service life of the concentrator.

Figure 6A:
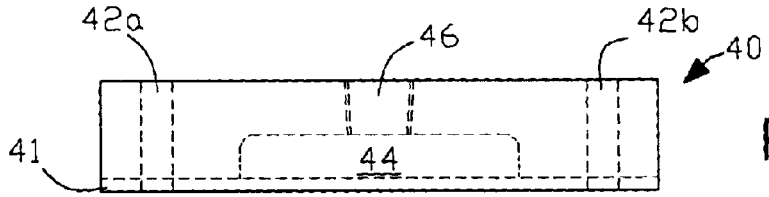
FIG. 6(*a*) is a front side view of one example of a top or bottom frame used in the inductor assembly shown in FIG. 1.
Figure 6B:
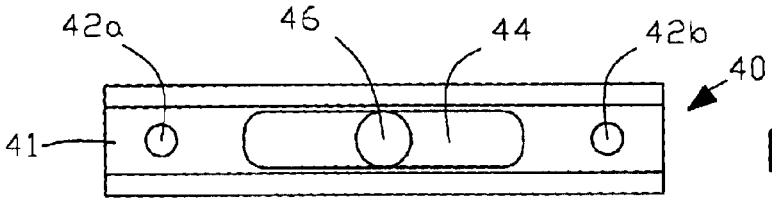
Figure 9:
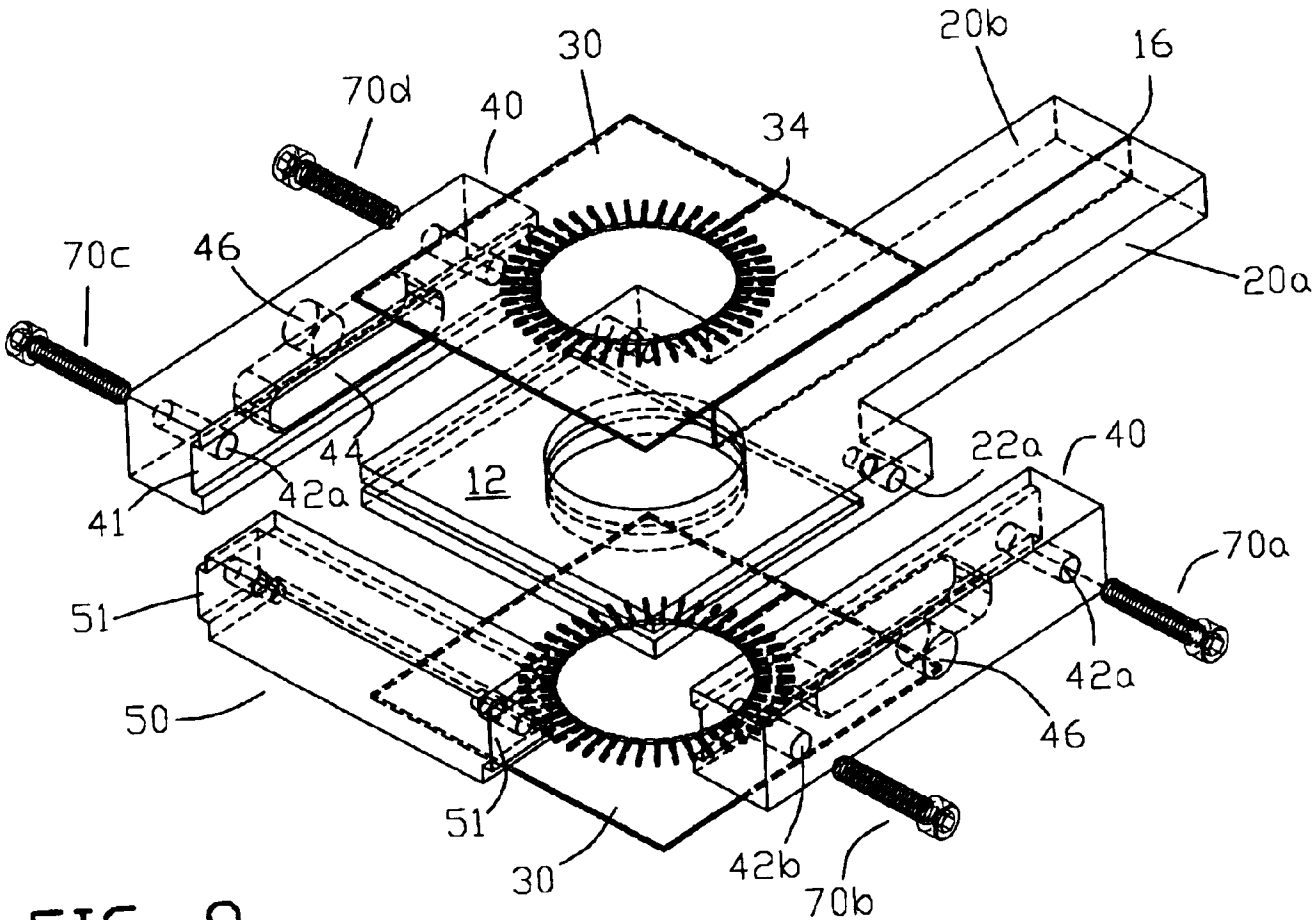
FIG. 9 is an exploded perspective view of one example of the inductor assembly of the present invention.

FIG. 6(*a*) and FIG. 6(*b*) illustrate one example of top and bottom frames 40. In this non-limiting example of the invention, the top and bottom frames can be machined from a 1-inch by 1-inch thick bar of electrically non-conductive stock material, such as a phenolic plastic, that is cut to an appropriate length for a particular inductor. Through holes 42*a* and 42*b* are drilled through the top and bottom frames. Quench chamber 44 can be machined into the top and/or bottom frames. Pipe tap 46 can be drilled into the top and/or bottom frames to provide a connection to a source of quench medium such as water. One longitudinal side of the top and bottom frames is machined to provide a means for joining the top and bottom frames to inductor 12, a pair of flux concentrators 30 and side frame 50 as further described below. In this particular example of the invention, U-shaped groove 41, as best seen in FIG. 9, is fabricated in one longitudinal side of the top and bottom frames. In other examples of the invention, only one of the top or bottom frame elements may include a means for providing the quench medium, such as chamber 44 and tap 46. As understood by one skilled in the art, side frame 50 may alternatively, or in addition to, be configured with a means for providing the quench medium.

Figure 7A:
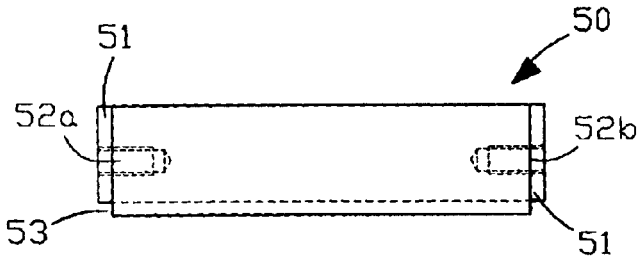
FIG. 7(*a*) is a front side view of one example of a side frame used in the inductor assembly shown in FIG. 1.
Figure 7B:
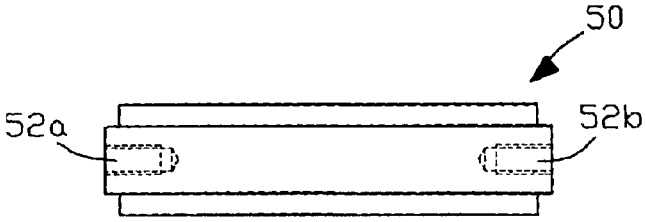

FIG. 7(*a*) and FIG. 7(*b*) illustrate one example of side frame 50. In this non-limiting example of the invention, the side frame can be machined from a 1-inch by 1-inch thick bar of electrically non-conductive stock material that is cut to an appropriate length for a particular inductor. The side frame is fabricated to provide a means for joining the side frame to the top and bottom frames as further described below. In this particular example of the invention, raised rectangular tongues 51, as best seen in FIG. 9, are machined into the top and bottom ends of the side frame for mating with the U-shaped grooves 41 in the top and bottom frames. One longitudinal side of the side frame is machined to provide a means for joining the frames to inductor 12, a pair of flux concentrators 30 and the top and bottom frames 40 as further described below. In this particular example of the invention, U-shaped groove 53 is machined in one longitudinal side of the side frame. Means for attaching fasteners to the side frame, such as threaded holes 52*a* and 52*b*, are milled into the side frame.

Figure 1:
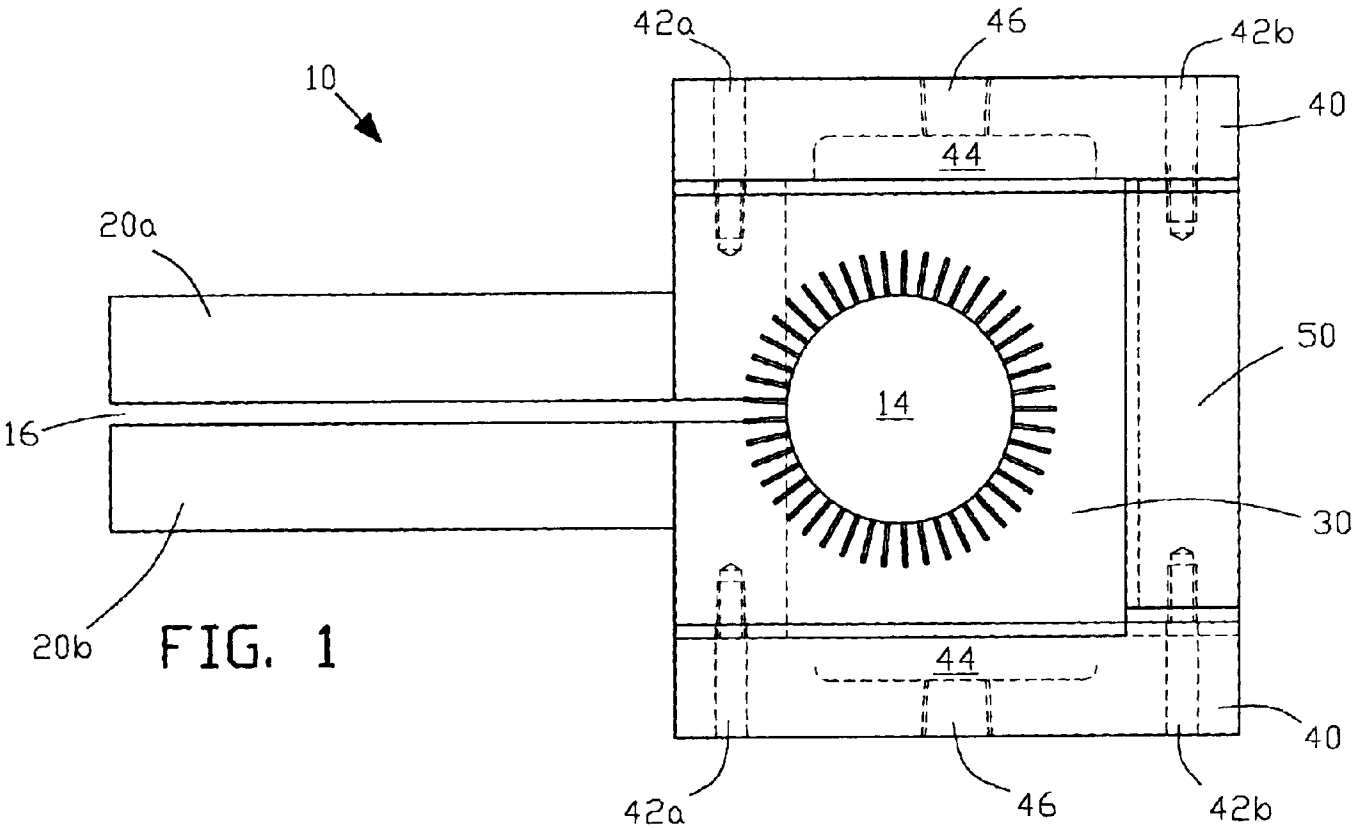
FIG. 1 is a front side view of one example of the inductor assembly of the present invention.
Figure 2:
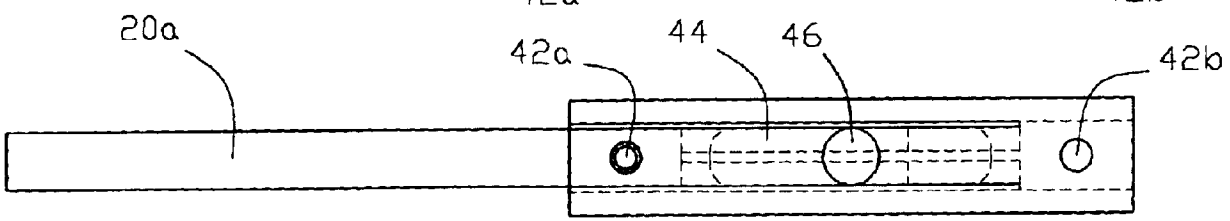
FIG. 2 is a top view of the inductor assembly shown in FIG. 1.
Figure 8:
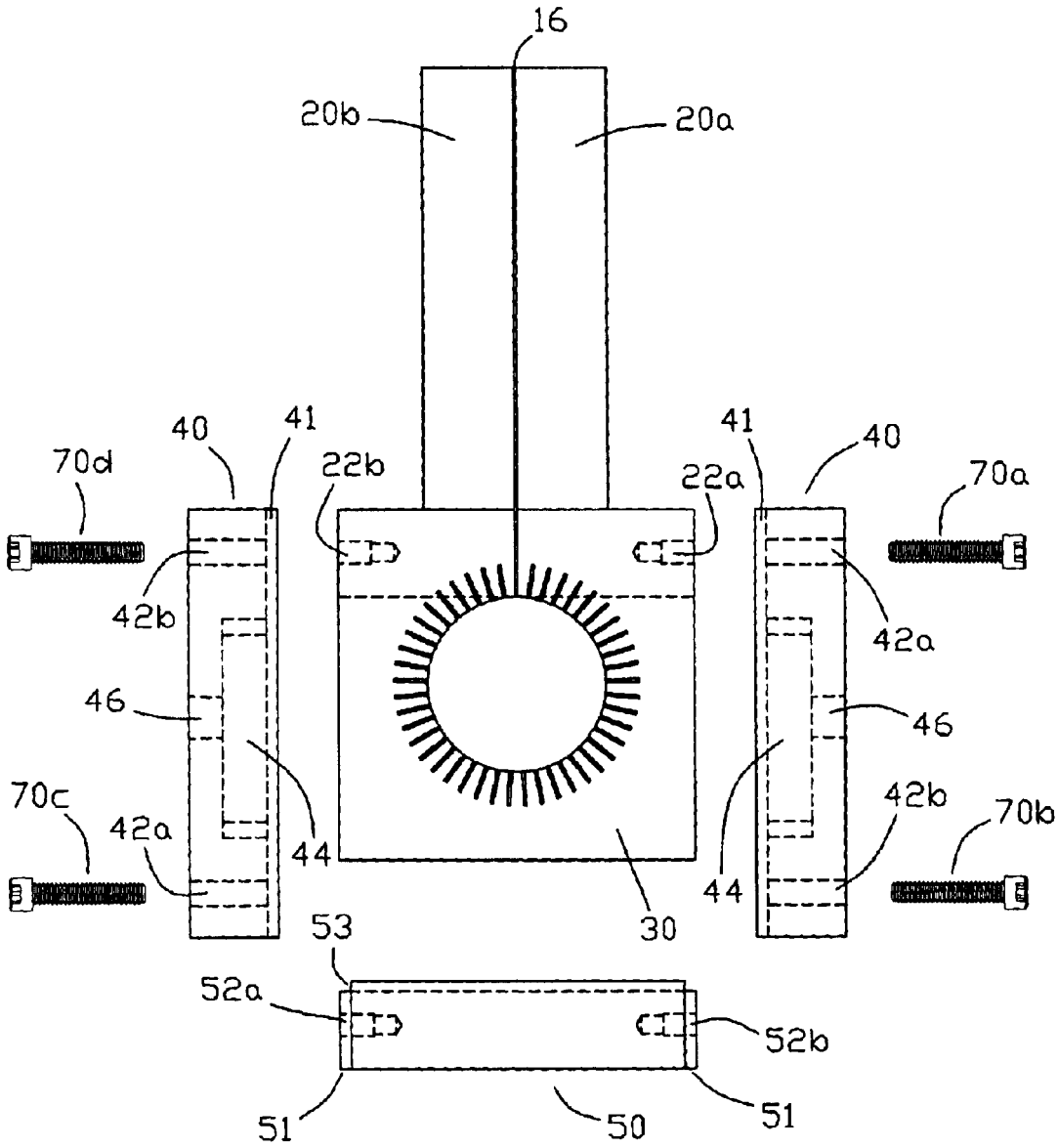
FIG. 8 is an exploded front side view of one example of the inductor assembly of the present invention.

FIG. 1 and FIG. 2 illustrate one example of an assembled inductor assembly 10 of the present invention. FIG. 8 and FIG. 9 provide exploded views of the inductor assembly. Top and bottom frames 40, and side frame 50, are fastened together around inductor 12 and a pair of flux concentrators 30. The flux concentrators are held in place on opposing sides (faces) of the inductor by the surrounding frames. When U-shaped grooves are used in the frame members (i.e., the top, side and bottom frames) the flux concentrators are kept in places by seating the edges of the flux concentrators in the U-shaped grooves. Fasteners 70*a*, 70*b*, 70*c* and 70*d* are used to hold the frames and flux concentrators in place around the inductor. With single phase ac current from a suitable power supply provided to legs 20*a* and 20*b* of inductor 12, the magnetic field created by the flow of current through the inductor will inductively heat an electrically conductive workpiece, such as a metal workpiece, that is placed within inductor opening 14. By altering the slots or otherwise configured openings in the flux concentrators, the pattern of the magnetic field can be altered to achieve a desired contoured heating of the workpiece inserted in coil opening 14. A collection of variously shaped flux concentrators may be provided with a particular inductor assembly to provide for alternative heat patterns with the same inductor assembly by simply changing the flux concentrators installed on the assembly. Further in some examples of the invention, a flux concentrator may be utilized on only one side, or face, of the inductor.

Connections to a quench medium are made at pipe taps 46 in the top and bottom frames 40 in the present example of the invention. The quench medium flows through pipe taps 46, into quench chambers 44, through inductor slot 18 and onto a workpiece placed within inductor opening 14 to quench the workpiece. Illustrated in the figures is a quench passage arrangement that gives a single loop hardness pattern for the workpiece placed inside inductor opening 14. Other quench patterns may be achieved with the inductor assembly of the present invention by appropriate machining of one or more frame members for different quench passages. For example, only the side frame may be provided with quench passages in other examples of the invention. Further inductor slot 18 is shown as an internal through passage in inductor 12 from inductor opening 14 to the top, bottom and side edges of the inductor, as best seen in FIG. 4. In other examples of the invention, inductor slot 18 (quench slot) may be an internal through passage from inductor opening 14 to the top, bottom and/or side edge of the inductor. Further the internal through passage may comprise a plurality of separate passages.

Inductor assembly 10 does not require inductor water cooling to minimize thermal fatigue of the inductor due to the compact size of the inductor and resultant short heat cycles. The flow of quench medium through inductor slot 18 also aids in cooling the inductor. Further, assembly of inductor assembly 10 can be accomplished without brazing, which eliminates the hazardous environmental problems associated with brazing.

The inductor assembly may be used in a number of different process. For example, a single inductor assembly 10 could be used and the workpiece, such as a camshaft, could be moved axially through the single inductor assembly so that each component on the workpiece to be hardened, such as the lobe of a camshaft, can be positioned within inductor opening 14. Alternatively a plurality of the inductor assemblies could be suitably mounted in a row so that all of the components on the workpiece to be heat treated could be heat treated at the same time. Depending upon the configuration of the workpiece and the components to be heat treated within inductor opening 14, the component may or may not rotate within inductor opening 14 while it is being inductively heat treated.

The foregoing examples do not limit the scope of the disclosed invention. The scope of the disclosed invention is further set forth in the appended claims.

What is claimed is:

1. An inductor assembly for induction heat treatment of a workpiece, the inductor assembly comprising:

an inductor formed from a single piece of an electrically conductive stock, the inductor having a workpiece opening passing through the width of the inductor, into which the workpiece can be inserted, and a pair of legs for connecting the inductor to a source of ac power, the legs electrically separated from each other by a leg slot to form an integral single-turn coil around the workpiece opening;

a flux concentrator disposed at least partially around the workpiece on at least one of the two opposing sides of the inductor; and a top, side and bottom frame member formed from an electrically non-conductive material and joined together to at least partially surround the top edge of the inductor, the side edge of the inductor opposing the pair of legs, and the bottom edge of the inductor, to hold the flux concentrators in place.

2. The inductor assembly of claim 1 further comprising:

a quench slot in the inductor, the quench slot forming an interior passage in the inductor from at least the top, side or bottom edge of the inductor to at least partially around the workpiece opening;

a quench chamber in at least the top, side or bottom frame member, the quench chamber connected to the quench slot in the inductor; and a means for connecting the quench chamber to a source of a quench medium.

3. An inductor assembly for induction heat treatment of a workpiece, the inductor assembly comprising:

an inductor formed from a single piece of an electrically conductive stock, the inductor having a workpiece opening passing through the width of the inductor, into which the workpiece can be inserted, and a pair of legs for connecting the inductor to a source of ac power, the legs electrically separated from each other by a leg slot to form an integral single-turn coil around the workpiece opening;

a flux concentrator disposed at least partially around the workpiece opening on at least one of the two opposing sides of the inductor;

a top and a bottom frame formed from an electrically non-conductive material, the top and bottom frame each having a U-shaped groove along a longitudinal side into which the top edges of the inductor and the flux concentrator seat into the top frame, and the bottom edges of the inductor and the flux concentrator seat into the bottom frame;

a side frame formed from an electrically non-conductive material, the side frame having a U-shaped groove along a longitudinal side into which the side edges of the inductor and the flux concentrator seat, the ends of the side frame having a tongue for seating in the U-shaped grooves of the top and bottom frames;

a means for fastening the top, side and bottom frames together to form a C-shaped frame around the top, side and bottom edges of the inductor, respectively, to hold the flux concentrator in place; and a means for fastening the top and bottom frames to the inductor.

4. The inductor assembly of claim 3 wherein the means for fastening the top, side and bottom frames together comprises fasteners inserted into through holes in the top and bottom frames and holes in the ends of the side frame.

5. The inductor assembly of claim 3 wherein the means for fastening the top and bottom frames to the inductor comprises fasteners inserted into through holes in the top and bottom frames and holes in the inductor.

6. The inductor assembly of claim 3 wherein the means for fastening the top, side and bottom frames together comprises fasteners inserted into through holes in the top and bottom frames and holes in the ends of the side frame, and the means for fastening the top and bottom frames to the inductor comprises fasteners inserted into through holes in the top and bottom frames and holes in the inductor.

7. The inductor assembly of claim 3 further comprising:

a quench slot in the inductor, the quench slot forming an interior passage in the inductor from at least the top, side or bottom edge of the inductor to at least partially around the workpiece opening;

a quench chamber in at least in the top, side or bottom frame member, the quench chamber connected to the quench slot in the inductor; and a means for connecting the quench chamber to a source of a quench medium.

8. A method of induction heat treating a workpiece comprising the steps:

fabricating a continuous, single-turn, inductor from a single piece of an electrically conductive stock by forming a workpiece opening through the width of the stock and forming a pair of legs in the stock by forming a leg slot in the stock to separate the pair of legs;

connecting the pair of legs to the output of an ac power supply;

placing a flux concentrator on at least one face of the two opposing faces of the inductor;

holding the flux concentrator in place by fastening an electrically non-conductive top, side and bottom frame member around the top edge of the inductor, the side edge of the inductor opposing the pair of legs, and the bottom edge of the inductor, respectively; and inserting the workpiece in the workpiece opening.

9. The method of claim 8 further comprising the steps of:

forming an interior quench slot from at least the top, side or bottom edge of the inductor to at least partially around the workpiece opening;

forming a quench chamber in at least the top, side or bottom frame member, the quench chamber connected to the interior quench slot;

connecting the quench chamber to a source of a quench medium; and supplying the quench medium to quench the workpiece via the quench chamber and interior quench slot.

* * * * *